United States Patent [19]

Puskarcik

[11] Patent Number: 4,579,254

[45] Date of Patent: Apr. 1, 1986

[54] COLLAPSIBLE TUBE CONTAINER

[76] Inventor: Ted Puskarcik, 487 Whipple Ave., Campbell, Ohio 44405

[21] Appl. No.: 612,318

[22] Filed: May 21, 1984

[51] Int. Cl.[4] ..... B65D 35/28

[52] U.S. Cl. ..... 222/95; 222/103; 222/105

[58] Field of Search ..... 222/92, 95, 103, 107, 222/105; 220/105; 206/277

[56] References Cited

U.S. PATENT DOCUMENTS

| | | | |
|---|---|---|---|
| 1,844,215 | 2/1932 | Edwards . | |
| 2,672,258 | 3/1954 | Marberg | 206/277 X |
| 2,809,771 | 10/1957 | Ward | 222/107 |
| 3,313,455 | 4/1967 | Kemmer | 222/103 |
| 3,648,895 | 3/1972 | Strazdins | 222/107 |
| 4,203,567 | 5/1980 | Featherstone | 222/105 X |
| 4,316,556 | 2/1982 | Ferrari | 222/95 |

*Primary Examiner*—Joseph J. Rolla
*Assistant Examiner*—Gregory L. Huson
*Attorney, Agent, or Firm*—Harpman & Harpman

[57] ABSTRACT

A collapsible tube container having a stiff non-collapsible wall portion with a progressively engagable tube follower for dispensing the material within the tube. The stiffened wall portion of the tube is engaged by the follower for progressive and controlled advancement along the length of the tube.

1 Claim, 5 Drawing Figures

COLLAPSIBLE TUBE CONTAINER

BACKGROUND OF THE INVENTION

1. Technical Field

This invention relates to collapsible tube containers having flexible wall surfaces in which the user collapses the same by squeezing the tube forcing the material within outwardly therefrom.

2. Description of the Prior Art

Prior art devices of this type have relied on a variety of different tube designs in which the tube has different interior configurations. See for example U.S. Pat. Nos. 1,844,215, 2,809,771 and 3,648,895.

In U.S. Pat. No. 1,844,215, a semi-collapsible metallic tube is shown having a wall stiffening member within the collapsed tube, the member having a half U-shaped configuration in cross section.

U.S. Pat. No. 2,809,771 discloses a baby food feeder having a tube-like body member, the end of which is held together by a spring clip so that the tube can be refilled with a semi-solid food and sealed. The tube is compressed extruding the food outwardly through a small opening to which a nipple is secured In U.S. Pat. No. 3,648,895, a collapsible tube container can be seen wherein areas of reduced wall thickness extend longitudinally oppositely disposed to one another so that the tube can be collapsed in a true flat fashion.

Applicant's device comprises a collapsible tube having a single stiff non-collapsible flat wall with a tube collapsing follower progressively engaging the flat wall and collapsible wall portion.

SUMMARY OF THE INVENTION

A collapsible tube container for dispensing semi-solid material comprising a tube with one flat stiff non-collapsible wall having a progressively engagable tube follower engagable over the tube that forces the material within the tube outwardly therefrom.

DESCRIPTION OF THE PREFERRED EMBODIMENT

Figure 1:
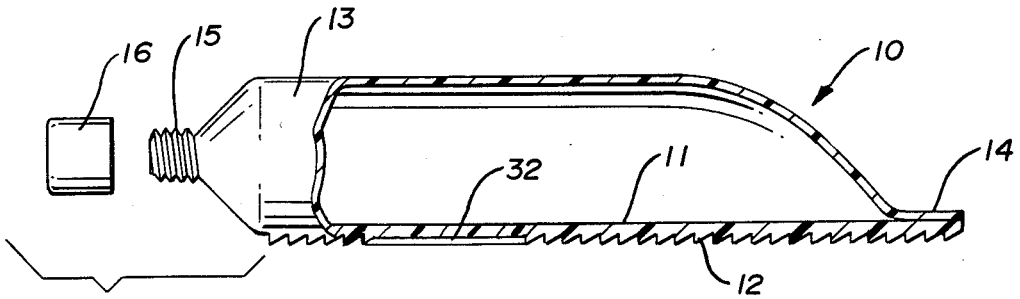
FIG. 1 is a side elevation of the collapsible tube with a portion broken away and parts in cross section.
Figure 2:
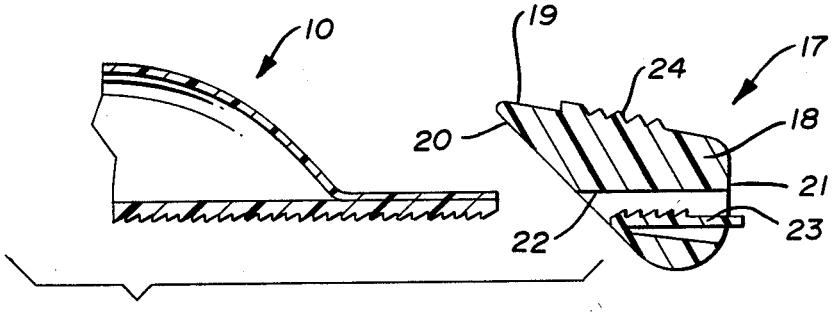
FIG. 2 is an enlarged cross sectional view of an end portion of the collapsed tube and a tube follower aligned for engagement thereon.
Figure 3:
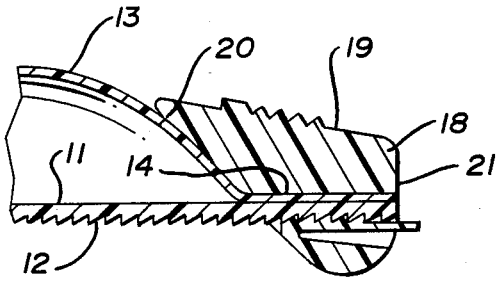
FIG. 3 is an enlarged cross sectional view of an end portion of the collapsible tube with a tube follower engaged thereon.

Referring to FIGS. 1,2 and 3 of the drawings, a collapsible tube container 10 can be seen having a flat relatively stiff base member 11 of an elongated rectangular configuration with a ratchet bottom surface 12 thereon. A continuous flexible wall member 13 extends in sealing relation from the perimeter of said base member having flexible sides, top and a flattened end portion

14 defined where the flexible wall member 13 engages a substantial portion of the upper end surface of said base member 11.

A threaded outlet 15 is formed integrally on the opposite end of said collapsible tube container 10 from said flexible wall member 13 as will be understood by those skilled in the art.

A cap 16 is threadably engagable on said threaded outlet 15 forming the collapsible tube container 10.

Figure 4:
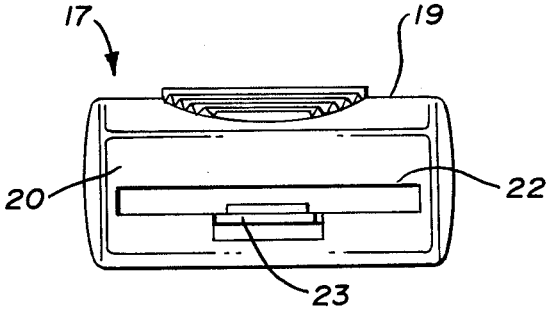
FIG. 4 is a front plan view of the tube follower in FIG. 2.

Referring now to FIGS. 2, 3 and 4 of the drawings, a tube follower 17 can be seen having an angularly shaped body member 18 with a converging upper surface 19 and end surfaces 20 and 21 respectively. An elongated rectangular aperture 22 extends through the tube follower from the converging end surface 20. A resilient ratchet member 23 is moveably secured and positioned within the aperture 22 and is registrable with said ratchet bottom surface 12 as best seen in FIG. 3 of the drawings. A multiplicity of textured ribs 24 extend transversely across a portion of the upper surface 19 of the tube follower 17 providing a non-slip user engagable area allowing the user adequate grip on the tube follower 17 so that the same can be advanced along the tube container 10 and held by the ratchet action therebetween as hereinbefore described and as best seen in FIG. 3 of the drawings.

Figure 5:
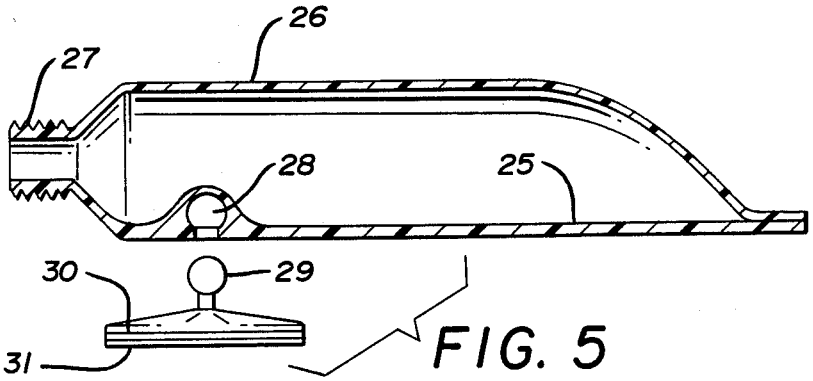
FIG. 5 is a cross sectional view of an alternate form of the invention.

Referring now to FIG. 5 of the drawings, an alternate form of the invention can be seen wherein a secondary collapsible tube container having a secondary stiff base member 25, a secondary continuous flexible wall member 26 and a secondary threaded outlet 27 wherein a ball type socket 28 is formed within said stiff base member 25 adjacent the secondary threaded outlet 27. The socket 28 is registrable on a mounting stud 29 having a base 30 with an adhesive back 31 as is well known in the art.

Yet another alternate form of the invention is generally indicated in FIG. 1 of the drawings, wherein a portion 32 of the stiffened base member 11 is smooth and is of a magnetized plastic material so that the same can be positioned on metal surfaces and the like.

It will thus be seen that a new and useful collapsible tube container has been illustrated and described and that it will be apparent to those skilled in the art that various changes and modifications may be made therein without departing from the spirit of the invention and having thus described my invention, what I claim is:

1. A collapsible tube container comprising an elongated tubular configuration having a flat stiff base member with upper and lower surfaces and longitudinally straight edges, a continuous flexible wall member in engagement with said longitudinal straight edges of said base member, said flexible wall member being capable of being flattened anywhere along its length, an outlet integral with said flexible wall member, a transverse ratchet configuration extending longitudinally on said lower surface of said stiff base member, a tube follower defining an elongated rectangular aperture, a resilient ratchet member moveably secured within the tube follower extending into said elongated rectangular aperture therein and selectively engaging said ratchet on the lower surface of said stiff base member when moved relative thereto.

* * * * *